United States Patent [19]

Headrick

[11] Patent Number: 4,792,143

[45] Date of Patent: Dec. 20, 1988

[54] FLYING DISC ENTRAPMENT ASSEMBLY

[76] Inventor: Edward E. Headrick, 4388-A Hill Rd., Lakeport, Calif. 95453

[21] Appl. No.: 132,397

[22] Filed: Dec. 15, 1987

[51] Int. Cl.[4] ..... A63B 67/06

[52] U.S. Cl. ..... 273/400

[58] Field of Search ..... 273/400, 177 A

[56] References Cited

U.S. PATENT DOCUMENTS

| | | | |
|---|---|---|---|
| 1,529,749 | 3/1925 | Morrison Jr. | 273/177 A |
| 4,039,189 | 8/1977 | Headrick et al. | 273/400 |
| 4,461,484 | 7/1984 | Headrick | 273/400 |

*Primary Examiner*—Paul E. Shapiro

*Attorney, Agent, or Firm*—Jackson & Jones

[57] ABSTRACT

An entrapment assembly is provided for use in flying disc golf game. The entrapment assembly comprises an upright post and an upwardly opening basket mounted on the post. A circular support bracket is mounted on the post with a plurality of outside and inside chains mounted to the bracket. The outside chains extend downwardly and inwardly to their lower ends which are secured to a first loose ring surrounding the post within the basket. The inside chains extend downwardly and straight or outwardly to their lower ends which are secured to a second loose ring of larger diameter than the first ring so that the outside and inside chains cross at a point below the top of the basket.

The outside and inside chains form a relatively dense energy absorbing medium in the path of a generally vertically oriented flying disc ensuring that the kinetic energy of the disc will be dissipated in the entrapment assembly, thereby causing the disc to call into the basket.

22 Claims, 1 Drawing Sheet

FLYING DISC ENTRAPMENT ASSEMBLY

BACKGROUND OF THE INVENTION

1. Field of the Invention

The present invention relates to flying disc entrapment assemblies and, more particularly, to entrapment assemblies which employ chains for absorbing the kinetic energy of a flying disc so that the disc comes to rest in a receptacle disposed below the chains.

2. Description of the Prior Art

Flying disc golf games have been become popular during the past decade. Such games are played on courses laid out in parks or other recreational areas. The courses consist of a number of "holes" such as nine or eighteen, with each hole having a "tee" from which a flying disc is originally thrown by each player and a post positioned a selected distance from the tee.

In playing the game, a flying disc, such as Frisbee TM (trademark of Whamo Co.), is thrown from each of the tees in the direction of the respective post. If the disc misses the post by landing short, etc. on the first throw, as is generally the case, the disc is picked up and thrown again. This process is repeated until the disc strikes the post. The number of throws required for each player to strike each of the posts are then added to provide the total score for that player. The player with the lowest score is the winner.

Since obstacles such as trees, etc. are often located between the tees and their respective posts it is necessary to ensure by means other than visual observation that each impact between a disc and a post is accurately determined. Entrapment devices for use in the game for capturing flying discs are known in the prior art. See, for example, U.S. Pat. No. 4,039,189 (of which I am a co-inventor) and U.S. Pat. No. 4,461,484 (of which I am the sole inventor). The teachings of my prior patents have proven to be important contributions to the sport of flying disc golf.

The teachings of my U.S. Pat. No. 4,461,484 patent greatly expanded the ability of the entrapment device to catch the modern small size heavy discs (e.g. 21 cm in diameter and 150+ grams in weight) that are now the standard of most amateur and professional players. Such players have developed new throwing techniques, such as an almost vertical orientation of the disc (for short throws) which has resulted in an occasional rejection of the disc by the catching device. The tolerance for the occasional rejection of a well thrown disc by the entrapment device has diminished as the skill of the players has increased. As a result there is a need for a more reliable disc entrapment device.

SUMMARY OF THE INVENTION

The shortcomings of the prior art entrapment devices are solved to a large extent by the entrapment assembly of the present invention. This invention, like the prior art devices of the above-referred-to patents, provides an upwardly opening annular basket mounted on a post with a circular support bracket mounted at the top of the post and a group of outside chains attached to the bracket at spaced annular positions. The lower ends of the outside chains are attached to a first ring surrounding the post and disposed within the basket so that the outside chains extend generally downwardly and inwardly to the post along parabolic curves. The outside chains absorb kinetic energy from a disc and reduce its velocity.

A plurality of inner chains are also attached to the support bracket at annular spaced positions intermediate the distance between the periphery of the bracket and the post. The lower ends of the inner chains are attached at spaced annular positions to a second ring surrounding the post and disposed within the basket.

Unlike the prior art devices, the diameter of the second ring is at least as great as the diameter of the circle defined by the points of attachment of the inner chains to the support bracket so that the inside chains extend through the outside chains intermediate the distance between the support bracket and the second ring. This construction provides a ring of intersecting chain for entangling and stopping discs which impact the entrapment assembly even at steep angles (near vertical orientation). This construction also ensures that discs impacting the assembly at more conventional angles are caught.

The features of the present invention can best be understood by reference to the accompanying description taken in conjunction with the drawing where like reference numerals indicate like parts.

DETAILED DESCRIPTION OF THE ILLUSTRATED EMBODIMENTS

Figure 1:
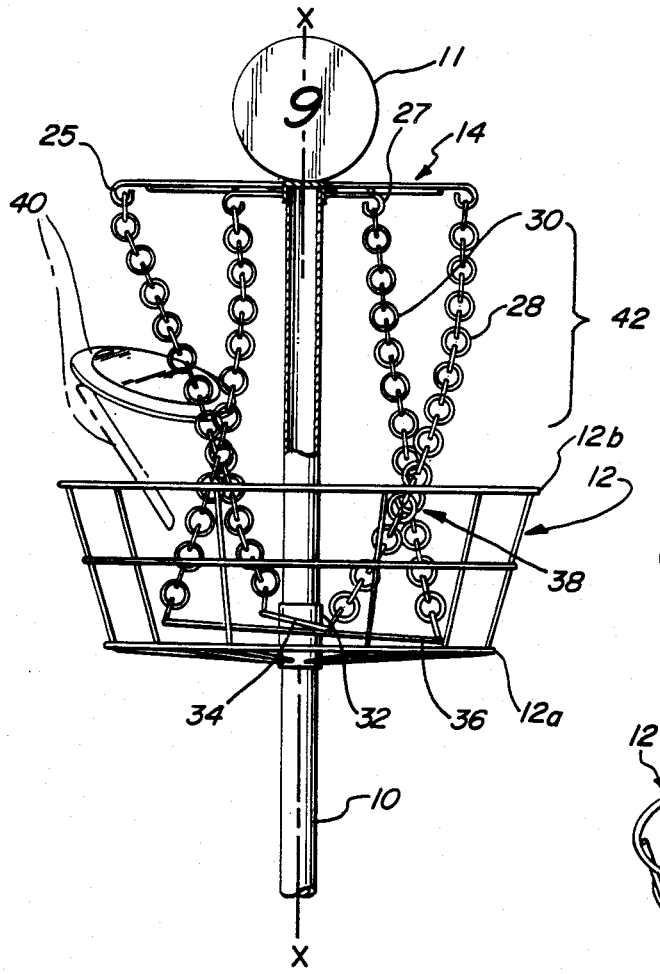
FIG. 1 is a cross-sectional view of a flying disc entrapment assembly in accordance with the present invention, and showing a disc being caught by the assembly.
Figure 2:
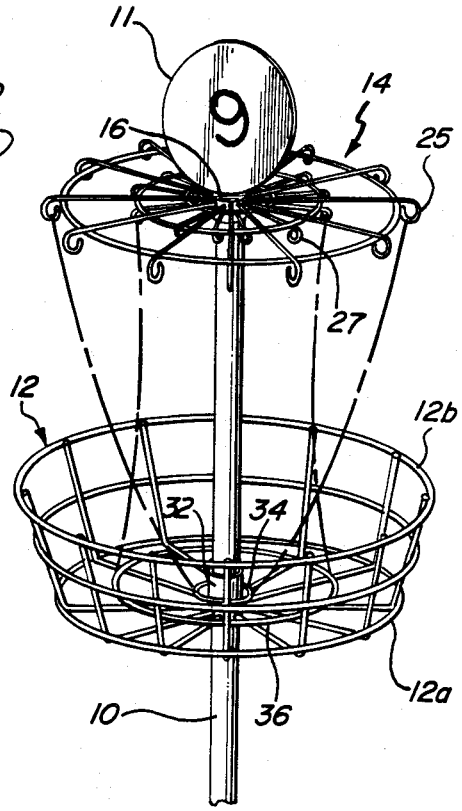
FIG. 2 is a perspective view of the assembly of FIG. 1.
Figure 3:
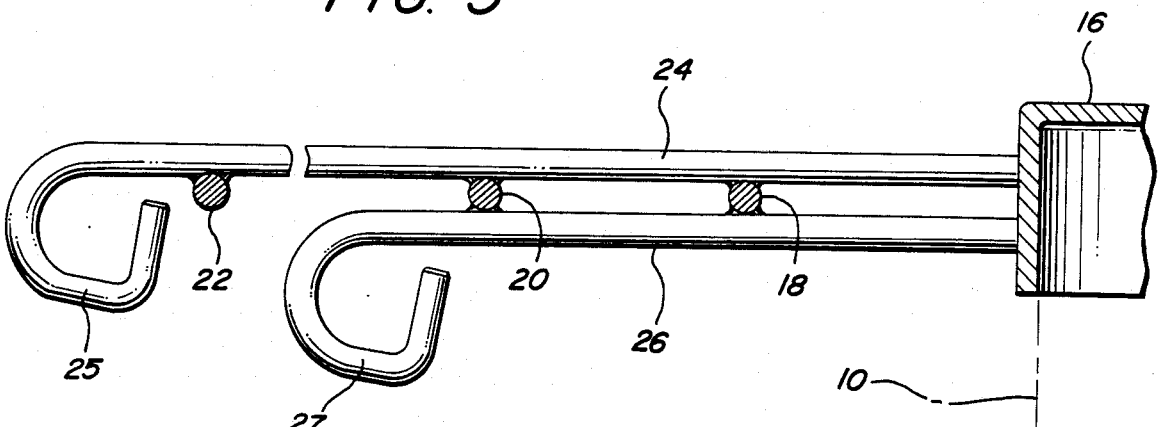
FIG. 3 is a partial cross-sectional view of the assembly of FIG. 1 enlarged to show the hooks which attached the chains to the support bracket mounted on top of the post.

Referring now to FIGS. 1, 2 and 3, a post 10 having a longitudinal axis x—x and designated as hole number 9 is mounted in an upright position in the ground by any suitable means such as in a concrete base (not shown). A support bracket 14 in the form of a cap 16, inner annular band (or ring) 18, intermediate band 20, an outer band 22 and a plurality radial support rods 24 and 26 is mounted to the top of the post by welding or by other suitable means. An upwardly opening basket 12 is secured to the post below the support bracket 14 via collar 32. A plurality of outside chains 28 (at least eight and preferably twelve in number) are mounted with the upper ends thereof attached at spaced annular positions (i.e., 30° apart) via hooks 25 to the radial support rods 24 of the bracket 14. The lower ends of the outside chains 28 are attached (e.g. by welding or otherwise) to a first loose ring 34, which surrounds the post 10 within the confines of the basket 12. The length of the outside chains allows the ring 34 to assume a position slightly above (e.g. ½") the bottom 12*a* of the basket 12.

A plurality of inside chains 32 (at least eight and preferebly twelve in number) are mounted with the upper ends thereof attached at spaced annular positions (i.e., 30° apart and offset 15° with respect to the outside chains) via hooks 27 to the radial support rods 26 of the support bracket 14. The lower ends of the inside chains 30 are attached to a second loose ring 36 which also surrounds the post 10 within the confines of the basket 12. The length of the inside chains allows the ring 36 to assume a position preferably slightly above the ring 34 (e.g. 1" above the bottom of the basket 12) although the vertical positioning of the rings 34, 36 may be reversed or equal.

In the preferred embodiment of the disc entrapment assembly, the basket 12 has an outer diameter of about twenty-four inches and a depth of about four inches to six inches. The outer diameter of the support bracket 14 (or diameter of the circle defined by the attachment points of the upper ends of the outside chains to the support bracket 14) is between sixteen to twenty-four inches and preferably between eighteen and twenty-two inches or approximately twenty inches. The distance between the support bracket 14 and the top of the basket 12 is about twenty inches. The diameter of the circle defined by the attachment points of the upper ends of the inside chains to the support bracket 14 (e.g. hooks 27) is within the range of six to ten inches and preferably about eight inches.

The diameter of the first ring 34 to which the lower ends of the outside chains are connected is somewhat larger than the diameter of the post to provide the ring with freedom of movement. Preferably the first ring has a diameter of two and one-half to three and one half inches or about three inches. The diameter of the second ring 36 to which the lower ends of the inside chains are connected is within the range of ten to fifteen inches and preferably within the range of twelve to fourteen inches or about thirteen inches.

The outside and inside chains are arranged to cross or intersect along a circular path (in the absence of a disc impact therewith) located below the top **12*b* of the basket 12. One such intersection is depicted at 38 in FIG. 1. This intersection of the chains locates the area of maximum stopping power of the chains below the normal impact area or strike zone of a disc which is indicated by 42 in FIG. 1**.

The strike zone 42 has been softened (as compared with the devices described in my prior U.S. Pat. No. 4,461,484) by a greater separation of the inner and outer chains. For example, the diameter of the circle defined by hooks 27 is preferably less than one-half the diameter of the circle defined by the hooks 25. This allows a lightly thrown disc or one nearing the end of its flight path to push aside the outer chains and gently fall into the inner chains which absorb the energy of the falling disc and cause it to land in the basket 12, as is illustrated by the flight of disc 40 in FIG. 1. In contrast, a disc impacting the strike zone at a high rate of velocity easily penetrates the outer chains and impacts the inner chains which because of their small radial separation (as compared to the outer chains) absorb considerably more energy when deflected by the disc. As an example, a flying disc will generally strike one outer chain squarely or glance off of two outer chains and then generally strike three inner chains. This action will stop almost any disc thrown at a high velocity. If the disc has kinetic energy left after striking the inner chains, it will normally strike the post and fall down into the basket 12. In the extreme case where the disc has enough energy to bounce off of the post, the chains behind, which have started to close up, will prevent the disc from exiting the entrapment device.

New throws have been developed by some enterprising players in which the disc strikes the entrapment assembly at a steep or negative angle of attack. A disc thrown in such a manner could and did occasionally hit the bottom of the basket of the prior art entrapment devices and bounce out without touching a chain or other energy absorbing element. In accordance with the present invention a ring of chain is placed (intersection of the outer and inner chains) in the path of such a throw, thereby entangling the disc in the concentration of chains at the point of intersection of the sloping chains.

A vertically thrown disc (i.e. substantially at 90° to the horizon presents a small target to the chains which are also vertically aligned. It has been determined that such vertically thrown discs impact at least two chains of the present entrapment assembly and usually get tangled up in several additional chains before falling into the basket 12. Test throwers up to the present have been unable to purposely throw, at any reasonable velocity, a disc through the strike zone and have it exit the other side without being caught in the basket.

There has thus been described a disc entrapment assembly which solves many of the problems inherent in the prior art devices and serves to reliably capture a disc which is thrown against the assembly. Various modifications of the embodiments described herein will be obvious to those skilled in the art. The claims are intended to cover such modifications which come within the spirit and scope of my invention.

What is claimed is:

1. An entrapment assembly for use in a flying disc game for arresting and trapping a flying disc thrown against the assembly comprising:

(a) an upright post;

(b) an upwardly opening annular basket mounted symmetrically on the post at an intermediate location;

(c) a circular support bracket mounted at the top of the post;

(d) a first ring surrounding the post and disposed within the basket;

(e) a plurality of outside chains having the upper ends thereof attached to the support bracket at spaced annular positions around the periphery thereof, and the lower ends thereof attached to the first ring at spaced annular positions around the periphery thereof, the outside chains being adapted to absorb kinetic energy of the disc and reduce its velocity;

(f) a second ring surrounding the post within the basket and having a diameter greater than the first ring; and (g) a plurality of inside chains having the upper ends thereof attached to the support bracket at spaced annular positions intermediate the distance between the periphery thereof and the post, and the lower ends attached at the spaced annular positions around the periphery of the second ring, the periphery of the first ring having a smaller circumference than the circumference defined by the points of attachment of the upper ends of the inside chains to the support bracket, the second ring having a circumference at least as great as the circumference defined by the points of attachment of the upper ends of the inside chains to the support bracket, whereby the inside chains extend through the outside chains intermediate the distance between support bracket and the second ring.

2. The entrapment assembly of claim 1 wherein the second ring has a circumference greater than the circumference defined by the points of attachment of the upper ends of the inside chains to the support bracket.

3. The entrapment assembly of claim 1 wherein the second ring has circumference substantially equal to the circumference defined by the points of attachment of the upper ends of the inside chains to the support bracket.

4. The entrapment assembly of claim 1 wherein the first and upper ends of the inside chains are arranged to be free to move longitudinally with respect to the post.

5. The entrapment assembly of claim 4 wherein the diameter of the circle defined by the points of attachment of the outside chains to the support bracket is within the range of sixteen to twenty-four inches.

6. The entrapment assembly of claim 5 wherein the diameter of the circle defined by the points of attachment of the outside chains to the support bracket is within the range of eighteen to twenty-two inches.

7. The entrapment assembly of claim 6 wherein the diameter of the circle defined by the points of attachment of the outside chains to the support bracket is about twenty inches.

8. The entrapment assembly of claim 5 wherein the diameter of the circle defined by the points of attachment of the inside chains to the support bracket is within the range of six to ten inches.

9. The entrapment assembly of claim 8 wherein the diameter of the circle defined by the points of attachment of the inside chains to the support basket is about eight inches.

10. The entrapment assembly of claim 8 wherein the diameter of the first ring is within the range of two and one-half to three and one-half inches.

11. The entrapment assembly of claim 10 wherein the diameter of the second ring is within the range of ten to fifteen inches.

12. The entrapment assembly of claim 11 wherein the diameter of the second ring is within the range of twelve to fourteen inches.

13. The entrapment assembly of claim 12 wherein the basket defines a bottom surface for supporting a disc and wherein the first and second rings are positioned about one-half to one inch above the bottom surface of the basket.

14. The entrapment assembly of claim 1 wherein the basket includes a top ring and wherein the outside and inside chains intersect below the top ring of the basket.

15. The entrapment assembly of claim 14 wherein the outside and inside chains are each at least eight in number.

16. The entrapment assembly of claim 15 wherein the outside and inside chains are each about twelve in number.

17. An entrapment assembly for use in a flying disc golf game for arresting and trapping a flying disc thrown against the assembly comprising:

(a) an upright post having a longitudinal axis;

(b) an upwardly opening annular basket mounted symmetrically on the post at an intermediate location;

(c) a circular support bracket mounted at the top of the post;

(d) at least eight outside chains having upper and lower ends, the upper ends thereof being attached to the support bracket at substantially equally spaced annular positions around the periphery thereof;

(e) means for mounting the lower ends of the outside chains in a first circular path around the post and within the basket, so that the outside chains extend inwardly and downwardly along substantially parabolic curves from the support bracket to a position adjacent the post within the basket;

(f) at least eight inside chains having upper and lower ends, the upper ends thereof being attached to the support bracket at substantially equally spaced annular positions intermediate the distance between the periphery thereof and the post; and (g) means for mounting the lower ends of the inside chains in a second circular path surrounding the post and within the basket, the second circular path having a diameter equal to or greater than the diameter of the circle defined by the points of attachment of the upper ends of the inside chains to the support bracket so that the inside and outside chains cross along a circular path located inside the basket.

18. The entrapment assembly of claim 17 wherein the number of each of the outside and inside chains is approximately twelve.

19. The entrapment assembly of claim 18 wherein the diameter of the circle defined by the points of attachment of the upper ends of the outside chains to the support bracket is about twelve to fourteen inches.

20. The entrapment assembly of claim 19 wherein the diamter of the circle defined by the points of attachment of the upper ends of the inside chains to the support bracket is about seven to nine inches.

21. The entrapment assembly of claim 21 wherein the diameter of the first circular path is about two and one-half to three and one-half inches.

22. The entrapment assembly of claim 20 wherein the diameter of the second circular path is about twelve to fourteen inches.

* * * * *